US011685065B2

(12) United States Patent
Zhang

(10) Patent No.: US 11,685,065 B2
(45) Date of Patent: Jun. 27, 2023

(54) KNIFE APPARATUS AND METHOD

(71) Applicant: Wei Zhang, Guangdong (CN)

(72) Inventor: Wei Zhang, Guangdong (CN)

(73) Assignee: MASTER CUTLERY LLC, Secaucus, NJ (US)

( * ) Notice: Subject to any disclaimer, the term of this patent is extended or adjusted under 35 U.S.C. 154(b) by 379 days.

(21) Appl. No.: 17/137,492

(22) Filed: Dec. 30, 2020

(65) Prior Publication Data

US 2021/0206007 A1 Jul. 8, 2021

(30) Foreign Application Priority Data

Jan. 2, 2020 (CN) ..... 202020002879.4

(51) Int. Cl.
*B26B 5/00* (2006.01)
*B25G 3/36* (2006.01)
*B25G 1/06* (2006.01)

(52) U.S. Cl.
CPC ..... *B26B 5/00* (2013.01); *B25G 1/06* (2013.01); *B25G 3/36* (2013.01)

(58) Field of Classification Search
CPC ..... B26B 5/00; B25G 1/06; B25G 3/36
See application file for complete search history.

(56) References Cited

U.S. PATENT DOCUMENTS

| | | | | |
|---|---|---|---|---|
| 11,426,888 | B1 * | 8/2022 | Mon | B25G 1/08 |
| 2008/0222896 | A1 * | 9/2008 | Marfione | B26B 5/00 30/160 |
| 2012/0023753 | A1 * | 2/2012 | Wen | B26B 1/046 30/156 |
| 2014/0041238 | A1 * | 2/2014 | Gilbert | B26B 5/00 29/428 |
| 2014/0245616 | A1 * | 9/2014 | Onion | B26B 1/04 29/434 |
| 2019/0217488 | A1 * | 7/2019 | Lo | B26B 5/00 |
| 2020/0338766 | A1 * | 10/2020 | Huang | B26B 5/00 |
| 2021/0101297 | A1 * | 4/2021 | Iverson | B26B 1/10 |
| 2022/0339805 | A1 * | 10/2022 | Kao | B26B 1/042 |
| 2023/0001591 | A1 * | 1/2023 | Okamura | B26B 5/00 |

* cited by examiner

*Primary Examiner* — Omar Flores Sanchez
(74) *Attorney, Agent, or Firm* — Walter J. Tencza, Jr.

(57) ABSTRACT

An apparatus including left and right handle portions; a first blade portion; a first device; and a fastener. The fastener may be configured to connect in a first state, first ends of the left handle portion, the right handle portion, and the first blade portion to each other, with the first blade portion sandwiched between the left and right handle portions. The first device may be configured to connect second ends of the left and right handle portions and an intermediate part of the first blade portion. In at least one embodiment, in the first state the left and right handle portions, and the first blade portion are fixed to each other so that their orientation with respect to one another cannot be changed without disconnecting the fastener so that it no longer connects the first ends of the left and right handle portions, and the first blade portion.

15 Claims, 7 Drawing Sheets

KNIFE APPARATUS AND METHOD

CROSS REFERENCE TO RELATED APPLICATION(S)

The present application claims the priority of Chinese patent application serial no. 202020002879.4, filing date Jan. 2, 2020, inventor Wei Zhang, Title: "A Cutting Tool with Detachable and Replaceable Blades."

FIELD OF THE INVENTION

This invention relates to devices for knives.

BACKGROUND OF THE INVENTION

There are various knives known in the art.

SUMMARY OF THE INVENTION

One or more embodiments of the present invention provide a utilitarian knife with detachable and replaceable blades, which comprises a left handle scale, portion, or plate, a right handle scale, portion, or plate and an intermediate metal piece, blade portion, or solid knife piece.

The right handle portion or plate is provided with a lock column on one side corresponding to the blade. The lock column includes a column, a rotating block and a clamping block arranged in sequence.

The left handle portion, scale or plate has a rotating hole. The side wall of the rotating hole is provided with a card slot; and the left handle portion is provided with a groove corresponding to the inner side of the rotating hole, and the blade is provided with a through hole, the size of that lock cylinder matches that hole, can pass through that hole. When the position of the clamping block and the clamping slot are in line, the clamping block can pass through the rotating hole and be inserted into the groove. At the same time, the rotating block is matched with the rotating hole. When the left handle portion, scale or plate and the right handle portion, scale or plate are aligned the block and the slot is staggered, and the cutter or blade also includes a locking mechanism that can prevent the rotation of the two handle portions or plates.

The disassembly and assembly of the overall apparatus is simple and fast. When the blade or blade portion is ground or needs to be replaced with a different type of blade or blade portion, the user can disassemble the left handle portion or plate and the right handle portion or plate at will.

There is shank, so that the blade portion can be replaced without waste of either the left or the right handle portions.

One or more embodiments of the present invention provide an apparatus comprising: a left handle portion; a right handle portion; a first blade portion; a first device; and a fastener.

The fastener may be configured to connect in a first state, first ends of the left handle portion, the right handle portion, and the first blade portion to each other, with the first blade portion sandwiched between the left handle portion and the right handle portion.

The first device may be configured to connect second ends of the left handle portion and the right handle portion and an intermediate part of the first blade portion.

In at least one embodiment, in the first state the left handle portion, the right handle portion, and the first blade portion are fixed to each other so that their orientation with respect to one another cannot be changed without disconnecting the fastener so that it no longer connects the first ends of the left handle portion, the right handle portion, and the first blade portion.

In at least one embodiment, removal of the fastener from the left handle portion, the first blade portion, and the right handle portion, allows the left handle portion to rotate with respect to the first blade portion and the right handle portion, while the left handle portion is connected to the first blade portion and the right handle portion.

In at least one embodiment, after removal of the fastener, with the left handle portion oriented to be at an angle with respect to the first blade portion and the right handle portion, the left handle portion and the right handle portion are configured to be separated from the first blade portion and from each other.

The first device may include a first plate fixed to the left handle portion, and a protrusion fixed to the right handle portion; and wherein after removal of the fastener, rotation of the left handle portion with respect to the first blade portion and the right handle portion allows the protrusion to line up with a slot in the first plate to thereby allow the removal of the left handle portion from the first blade portion and the right handle portion.

In at least one embodiment, in the first state, the protrusion is substantially perpendicular to the slot of the first plate, thereby preventing the left handle portion from being separated from the first blade portion and the right handle portion.

The protrusion is typically inserted through an opening in the first blade portion and through an opening in the first plate to thereby connect the second ends of the left handle portion and the right handle portion, and the intermediate part of the first blade portion, with the first blade portion sandwiched between the left handle portion and the right handle portion.

The fastener is typically inserted through an opening in the first blade portion and through an opening of the left handle portion to thereby connect the first ends of the left handle portion, the right handle portion, and the first blade portion, with the first blade portion sandwiched between the left handle portion and the right handle portion, in the first state.

In at least one embodiment, the left handle portion, the right handle portion, and the first blade portion are substantially parallel to each other in the first state.

In at least one embodiment the apparatus further includes a second blade portion; wherein the first blade portion is configured to be detached from the left handle portion and the right handle portion; wherein the second blade portion is configured to replace the first blade portion and to be attached to the left handle portion and the right handle portion; wherein the fastener is configured to connect in a second state, first ends of the left handle portion, the right handle portion, and the second blade portion to each other, with the second blade portion sandwiched between the left handle portion and the right handle portion; wherein the first device is configured to connect second ends of the left handle portion and the right handle portion and an intermediate part of the second blade portion; wherein in the second state the left handle portion, the right handle portion, and the second blade portion are fixed to each other so that their orientation with respect to one another cannot be changed without disconnecting the fastener so that it no longer connects the first ends of the left handle portion, the right handle portion, and the second blade portion; and wherein removal of the fastener from the left handle portion, the right handle portion, and the second blade portion allows the left handle portion to rotate with respect to the second blade portion and the right handle portion, while the left handle portion is connected to the second blade portion and the right handle portion.

A method is also provided, which may include fixing a left handle portion, a right handle portion, and a first blade portion together in a first state by use of fastener and a first device so that the left handle portion, the right handle portion, and the first blade portion are fixed in orientation and position with respect to each other; removing the fastener from the left handle portion, the right handle portion, and the first blade portion; and rotating the left handle portion with respect to the right handle portion and the first blade portion, while the left handle portion, the right handle portion and the first blade portion are connected together.

The method may include separating the left handle portion and the right handle portion from each other and from the first blade portion after removal of the fastener, with the left handle portion oriented to be at an angle with respect to the first blade portion and the right handle portion.

The first device may include a first plate fixed to the left handle portion, and a protrusion fixed to the right handle portion; wherein after removal of the fastener, rotation of the left handle portion with respect to the first blade portion and the right handle portion allows the protrusion to line up with a slot in the first plate to thereby allow the removal of the left handle portion from the first blade portion and the right handle portion.

The method may further include, detaching the first blade portion from the left handle portion and the right handle portion; replacing the first blade portion with a second blade portion; and attaching the second blade portion to the left handle portion and the right handle portion; wherein the fastener is configured to connect in a second state, first ends of the left handle portion, the right handle portion, and the second blade portion to each other, with the second blade portion sandwiched between the left handle portion and the right handle portion; wherein the first device is configured to connect second ends of the left handle portion and the right handle portion and an intermediate part of the second blade portion; wherein in the second state the left handle portion, the right handle portion, and the second blade portion are fixed to each other so that their orientation with respect to one another cannot be changed without disconnecting the fastener so that it no longer connects the first ends of the left handle portion, the right handle portion, and the second blade portion; and wherein removal of the fastener from the left handle portion, the right handle portion, and the second blade portion allows the left handle portion to rotate with respect to the second blade portion and the right handle portion, while the left handle portion is connected to the second blade portion and the right handle portion.

DETAILED DESCRIPTION OF THE DRAWINGS

Figure 1:
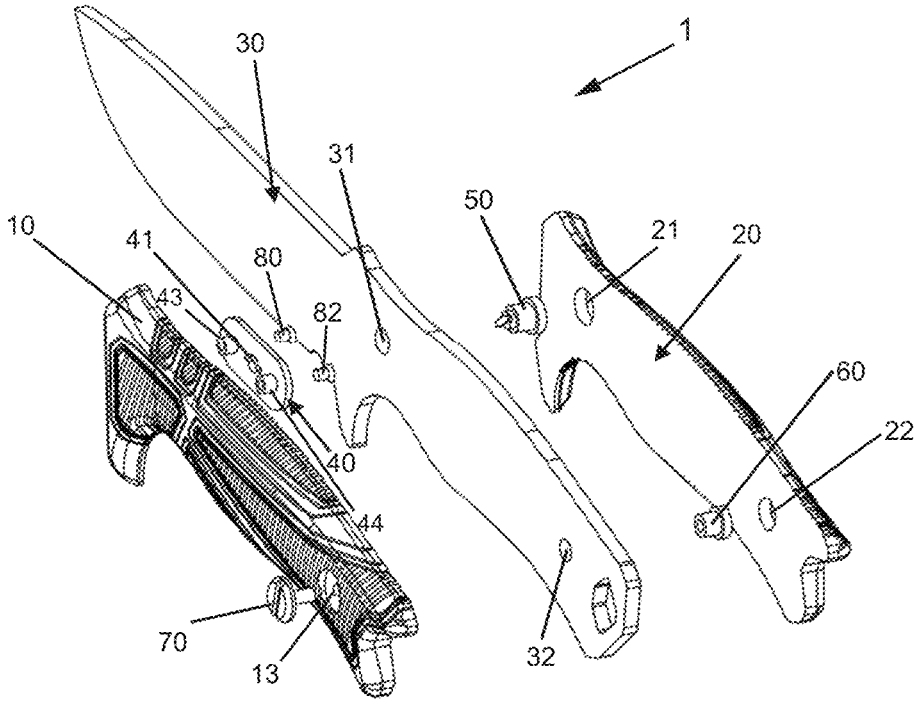
FIG. 1 shows a top, rear, and left side perspective view of an apparatus in accordance with an embodiment of the present invention, with the apparatus shown taken apart.
Figure 2:
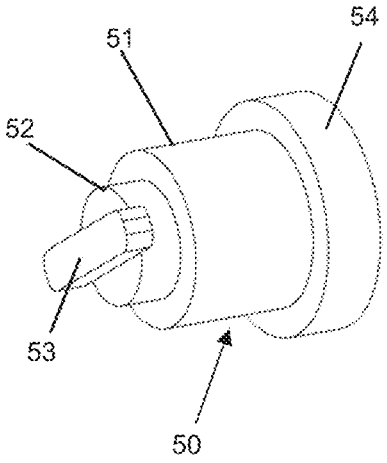
FIG. 2 shows a perspective view of a first device of the apparatus of FIG. 1.
Figure 3:
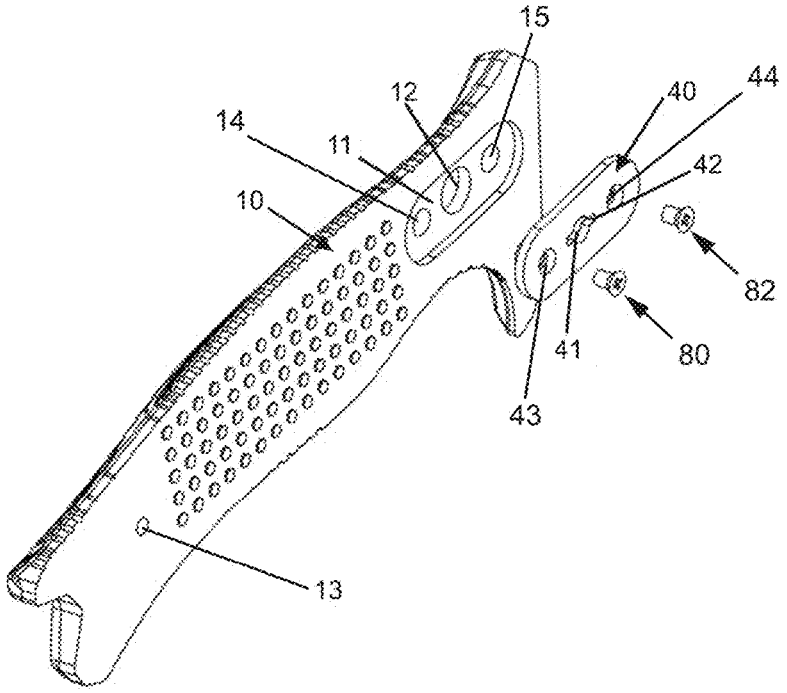
FIG. 3 shows a perspective view of a plate, a second device, and two fasteners of the apparatus of FIG. 1.
Figure 4:
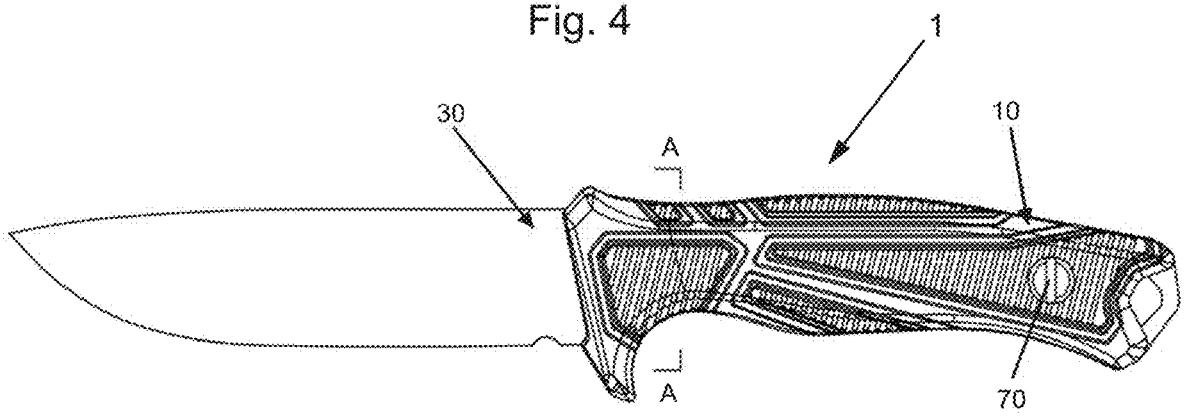
FIG. 4 shows a left side view of the apparatus of FIG. 1, with the apparatus of FIG. 1 assembled and in a first state and with the letters AA shown.
Figure 5:
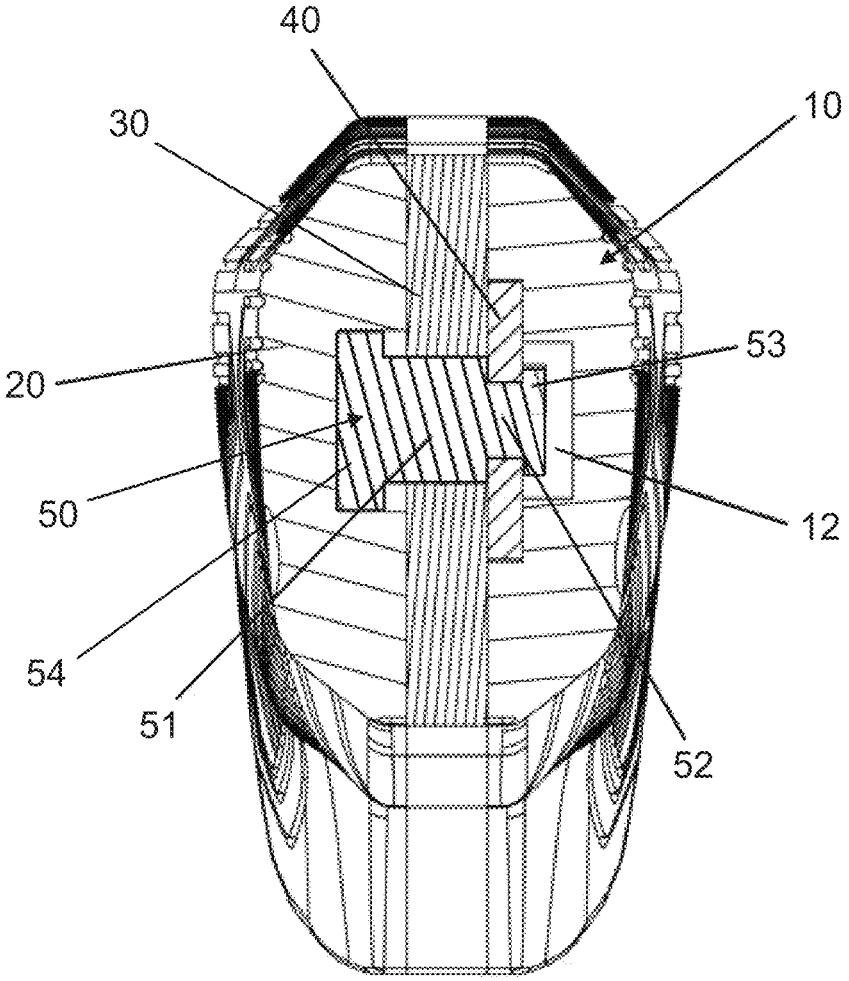
FIG. 5 shows a cutout sectional view of the apparatus of FIG. 1, along the line AA shown in FIG. 4.
Figure 6:
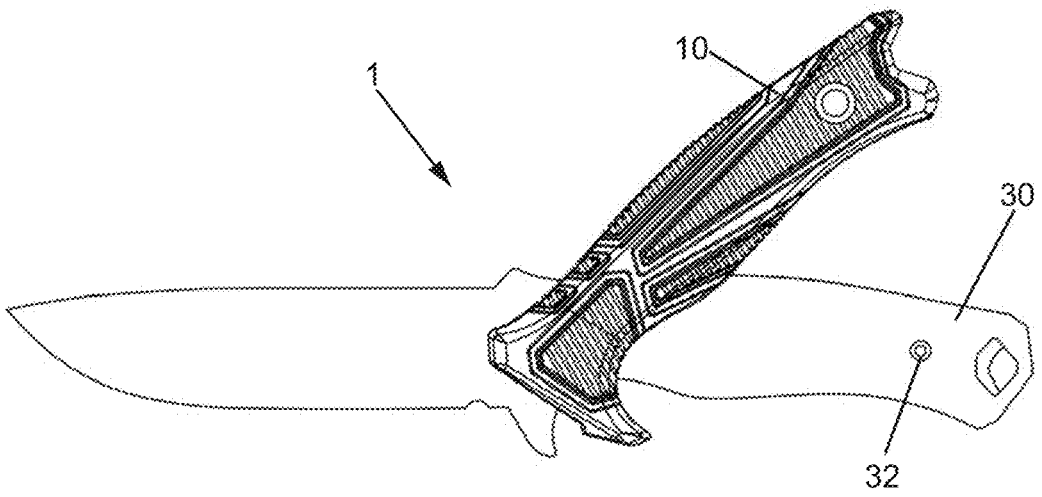
FIG. 6 shows left side view of the apparatus of FIG. 1, with the apparatus of FIG. 1 assembled and in a second state.

FIG. 1 shows a top, rear, and left side perspective view of an apparatus 1 in accordance with an embodiment of the present invention, with the apparatus 1 shown taken apart. FIG. 2 shows a perspective view of a first device 50 of the apparatus of FIG. 1. FIG. 3 shows a perspective view of a plate 10, a second device 40, and two fasteners 80 and 82 of the apparatus 1 of FIG. 1. FIG. 4 shows a left side view of the apparatus 1 of FIG. 1, with the apparatus 1 of FIG. 1 assembled and in a first state and with the letters AA shown. FIG. 5 shows a cutout sectional view of the apparatus 1 of FIG. 1, along the line AA shown in FIG. 4. FIG. 6 shows left side view of the apparatus 1 of FIG. 1, with the apparatus 1 of FIG. 1 assembled and in a second state.

Referring to FIGS. 1-6, the apparatus 1 includes the plate 10, a plate 20, and a knife or blade 30. The apparatus 1 further includes the second device 40, the first device 50, a device 60, and a fastener 70.

The fastener 70 may be a screw or a bolt. The fasteners 80 and 82 may be screws or bolts.

It is critical and preferred in at least one embodiment that the knife or blade 30 be a solid hard metal integrated unit. The knife or blade 30 includes openings 31 and 32. A stem portion of the screw or bolt 70 is inserted through an opening an opening 13 in the plate 10, through an opening 32 in the knife or blade 30, into device 60, and device 60 is inserted into recess 22 to thereby connect one end of the plate 10, blade 30, and plate 20 together. The device 60 is preferably fixed into the recess 22 such as by gluing or close form fitting into the recess 22 so that device 60 does not rotate in recess 22.

Stem portions of fasteners 80 and 82 are inserted through openings 43 and 44, respectively, and into openings 14 and 15, respectively of the plate 10 to attach the device 40 to the plate 10 within recess 16.

FIG. 5 shows a cap portion 54 of the device 50 within a recess 21 of the plate 20, a portion 51, at least partially, within opening 31 of the blade, blade portion, or knife 30, a portion 52 within an opening 41 of device 40, which is within a recess of plate 10. The device 50 is typically fixed to the plate 20 in recess 21 as shown in FIG. 5, by for example glue, epoxy, or by a tight fit within recess 21 so that cap portion 54 and device 50 does not rotate with respect to plate or right side handle 20.

One or more embodiments of the present invention provide a utilitarian knife or apparatus 1 with detachable and replaceable blades for blade 30, which comprises a left handle or handle portion or plate 10, a right handle or plate or portion 20 and an intermediate metal piece, blade, solid knife piece, or blade portion 30.

The right handle or plate 20 is provided with a lock column or device 50 corresponding to an opening 31 of the blade 30, such that portion 51 fits within opening 31 of the blade portion 30. The lock column or device 50 includes a column or portion 51, a rotating block 52, and a clamping block or protrusion 53 arranged in sequence.

Figure 7A:
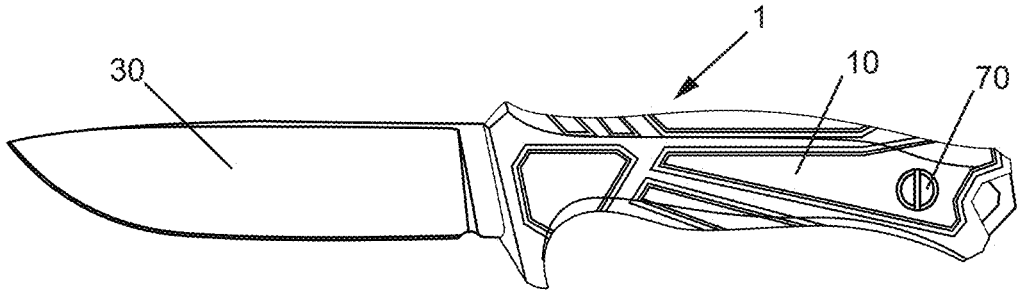
FIG. 7A shows a left side simplified view of the apparatus of FIG. 1 in a fully assembled state.

The left handle scale or plate 10 has a recess 12, in which rotation of the protrusion 53 occurs, beyond the plate 40, after the protrusion 53 has been through the slot 42 of the plate 40. The plate 40 is fixed to the left handle or plate 10, by fasteners 80 and 82, which may be bolts or screws, as shown in FIG. 3. The plate 40 has a circular opening 41, and a rectangular slot 42 cutting across the circular opening 41. The protrusion 53 of the device 50, while the device 50 is fixed in position and orientation in the handle portion 20, can be inserted through the opening 31 of the blade 30, and then through the rectangular slot 42 of the plate 40, and then into the recess 12 of handle portion 10, when the handle portion 10 is substantially perpendicular to the handle portion 20 and the blade portion 30 as shown by FIGS. 7D and 7E.

Figure 7B:
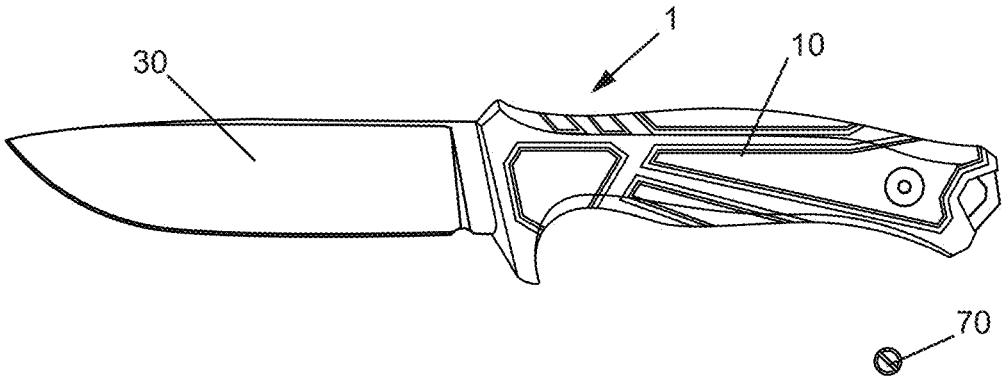
FIG. 7B shows a left side simplified view of the apparatus of FIG. 1 in a state in which a fastener has been separated from the rest of the apparatus of FIG. 1, to allow rotation of a left handle portion with respect to the rest of the apparatus of FIG. 1.
Figure 7C:
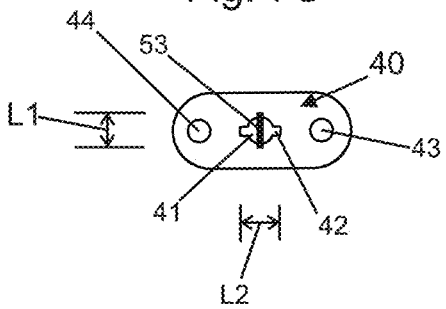
FIG. 7C shows the orientation of a number of components of the apparatus of FIG. 1, with respect to one another, when the apparatus is in the state of FIG. 7A, such that a first blade or first blade portion is substantially parallel with both left and right handle portions.
Figure 7D:
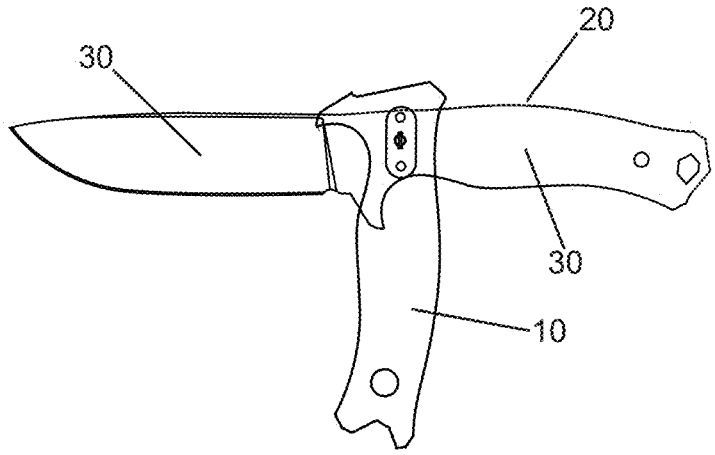
FIG. 7D shows a left side simplified view of the left handle portion rotated about ninety degrees with respect to the first blade portion.
Figure 7E:
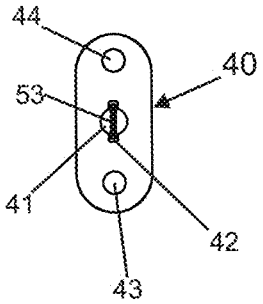
FIG. 7E shows the orientation of a number of components of the apparatus of FIG. 1, not including the fastener shown in FIG. 7B, which has been removed, with respect to one another, when the apparatus is in the state of FIG. 7D, such that the first blade portion is substantially perpendicular to the left handle portion but substantially parallel to the right handle portion.

With the protrusion 53 within the recess 12, after insertion through the rectangular slot of the plate 40, as shown in FIG. 5, the handle portion 10, with the protrusion 53 inserted in recess 12, can be rotated from the position of FIG. 7D to the position of FIG. 7B, which causes the protrusion 53 to be perpendicular to the rectangular slot 42 so that the handle portion 10 cannot be separated from the portions 20 and 30. Thereafter, the fastener 70 can be inserted to lock the portions 10, 20, and 30 in place, substantially parallel to one another as in FIG. 4.

When the left handle portion or plate 10 and the right handle or plate 20 are parallel to each other or aligned as in FIG. 4, the position of the block or protrusion 53 and the rectangular slot 42 are staggered or perpendicular to each other, and the cutter or blade portion 30 also includes a locking mechanism, such as fastener, bolt or screw 70 that can prevent the rotation of the two handle portions or plates 10 and 20, which respect to each other.

The disassembly and assembly of the overall apparatus 1 is simple and fast. When the blade 30 is ground or needs to be replaced with different type of blade or the same type of blade the user can disassemble the left handle portion or plate 10 and the right handle portion or plate 20 at will, as shown by FIGS. 7A-7J and the description relating thereto.

Figure 7F:
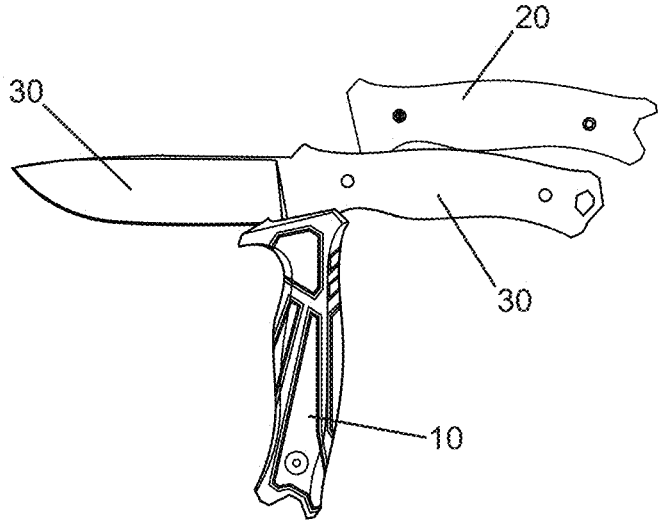
FIG. 7F shows a left side simplified view of the left handle portion rotated about ninety degrees with respect to the first blade portion, and with the left handle portion and the right handle portion separated from the first blade portion.
Figure 7G:
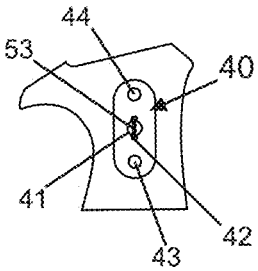
FIG. 7G shows the orientation of a number of components of the apparatus of FIG. 1 with respect to one another, when the apparatus is in the state of FIG. 7D, such that the first blade portion is substantially perpendicular to the left handle portion but substantially parallel to the right handle portion.
Figure 7H:
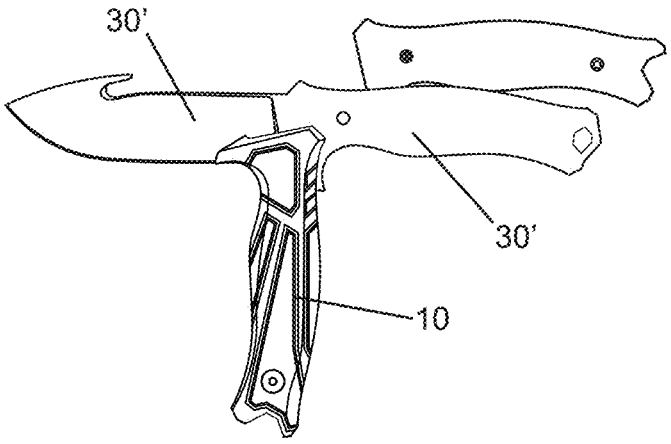
FIG. 7H shows a left side simplified view of the left handle portion rotated about ninety degrees with respect to a second blade or second blade portion, different from the first blade portion shown in FIG. 7A, and with the left handle portion and the right handle portion separated from the second blade portion.
Figure 7I:
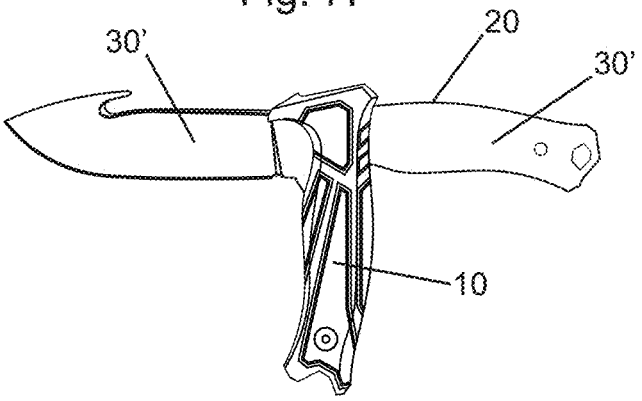
FIG. 7I shows a left side simplified view of the left handle portion rotated about ninety degrees with respect to the second blade portion, different from the first blade portion shown in FIG. 7A, and with the left handle portion and the right handle portion connected to the second blade portion.
Figure 7J:
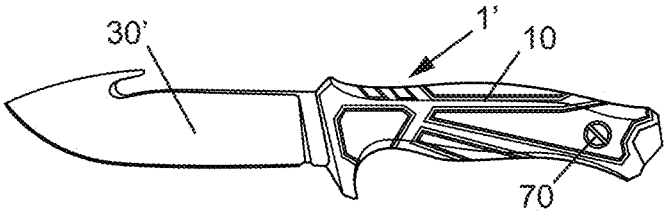
FIG. 7J shows a left side simplified view of a second apparatus in a fully assembled state, with the fastener of FIG. 7B connected to the second apparatus, such that the difference between FIG. 7J and FIG. 7A, is that the first blade portion differs from the second blade portion.

The blade portion 30 can be replaced, such as with blade portion 30' shown in FIG. 7H-7J without waste of either the left handle or plate 10 or the right handle or plate 20.

In at least one embodiment, with the apparatus 1 in the assembled state shown in FIG. 4, the fastener 70 can be unscrewed so that the plates 10 can be rotated with respect to the blade or knife 30, and with respect to the plate 20 as shown by the change from FIG. 4 to FIG. 6. Note that FIG. 6 does not show the plate 20, which would remain in the same position as in FIG. 4. The plate 10 preferably is rotated to an angle of approximately ninety degrees with respect to the blade or knife 30 and with respect to the plate 20 which is attached to the knife 30. The plate 10 is rotated into an unlock position so that component 53 is aligned with slot 42 of device 40, so that plate 10 can be lifted off of the combination of the blade 30 and the plate 20.

The plate 20 and the blade 30 can then be separated, and a new blade 30 provided. The new blade 30 is first attached to the plates 10 and 20 so that the plate 10 is at an angle, which is preferably about ninety degrees with respect to the new blade 30 and the plate 20. Then the handle 10 is rotated to the position shown by FIG. 4, and the fastener 70 reinserted to attach plates 10, 20 and blade 30 as in FIG. 4.

FIG. 7A shows a left side simplified view of the apparatus 1 of FIG. 1 in a fully assembled state.

FIG. 7B shows a left side simplified view of the apparatus 1 of FIG. 1 in a state in which a fastener 70 has been separated from the rest of the apparatus 1 of FIG. 1, to allow rotation of a left handle portion 10 with respect to the rest of the apparatus 1 of FIG. 1.

FIG. 7C shows the orientation of a number of components of the apparatus 1 of FIG. 1, with respect to one another, when the apparatus 1 is in the state of FIG. 7A, such that a first blade or first blade portion 30 is substantially parallel with both left and right handle portions 10 and 20, respectively. FIG. 7C shows protrusion 53 oriented with respect to plate 40, such that protrusion 53 prevents the handle portions 10 and 20 being separated from each other and from the blade portion 30. The protrusion 53 has a length L1 shown in FIG. 7C, which is longer than the diameter of the circular opening 41 of the plate 40. The protrusion 53 when oriented as in FIG. 7C, with respect to plate 40, which occurs when the apparatus is fully assembled as in FIG. 7A, extends beyond the opening 41 at both of its ends, overlapping the typically hard metal body of plate 40, and preventing the left handle portion 10, right handle portion 20, and blade portion 30 from being separated from each other.

FIG. 7D shows a left side simplified view of the left handle portion 10 rotated about ninety degrees with respect to the first blade portion 30.

FIG. 7E shows the orientation of a number of components of the apparatus 1 of FIG. 1, not including the fastener 70 shown in FIG. 7B, which has been removed, with respect to one another, when the apparatus 1, minus fastener 70, is in the state of FIG. 7D, such that the first blade portion 30 is substantially perpendicular to the left handle portion 10 but substantially parallel to the right handle portion 20. In the state of FIG. 7D, the protrusion 53 is oriented in slot 42. The length L1 of protrusion 53, shown in FIG. 7C is slightly less than the length L2 of the slot 42, which allows the left handle portion 10 and the right handle portion 20 to be separated from the first blade portion 30, when the components 10, 20, and 30 are oriented as shown by FIG. 7D, 7E, and 7F.

FIG. 7F shows a left side simplified view of the left handle portion 10 rotated about ninety degrees with respect to the first blade portion 30, and with the left handle portion 10 and the right handle portion 20 separated from the first blade portion 30.

FIG. 7G shows the orientation of a number of components of the apparatus 1 of FIG. 1 with respect to one another, when the apparatus 1 is in the state of FIG. 7D, such that the first blade portion 30 is substantially perpendicular to the left handle portion 10 but substantially parallel to the right handle portion 20.

FIG. 7H shows a left side simplified view of the left handle portion 10 rotated about ninety degrees with respect to a second blade or second blade portion 30', different from the first blade portion 30 shown in FIG. 7A, and with the left handle portion 10 and the right handle portion 20 separated from the second blade portion 30'.

FIG. 7I shows a left side simplified view of the left handle portion 10 rotated about ninety degrees with respect to the second blade portion 30', different from the first blade portion 30 shown in FIG. 7A, and with the left handle portion 10 and the right handle portion 20 connected to the second blade portion 30'.

FIG. 7J shows a left side simplified view of a second apparatus 1' in a fully assembled state, with the fastener 70 of FIG. 7B connected to the second apparatus 1', such that the difference between FIG. 7J and FIG. 7A, is that the first blade portion 30 differs from the second blade portion 30'.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a left handle portion;

a right handle portion;

a first blade portion;

a first device;

and a fastener;

wherein the fastener is configured to connect in a first state, first ends of the left handle portion, the right handle portion, and the first blade portion to each other, with the first blade portion sandwiched between the left handle portion and the right handle portion;

wherein the first device is configured to connect second ends of the left handle portion and the right handle portion and an intermediate part of the first blade portion;

wherein in the first state the left handle portion, the right handle portion, and the first blade portion are fixed to each other so that their orientation with respect to one another cannot be changed without disconnecting the fastener so that it no longer connects the first ends of the left handle portion, the right handle portion, and the first blade portion;

wherein removal of the fastener from the left handle portion, the first blade portion, and the right handle portion, allows the left handle portion to rotate with respect to the first blade portion and the right handle portion, while the left handle portion is connected to the first blade portion and the right handle portion;

wherein the first device includes a first plate fixed to the left handle portion, and a protrusion fixed to the right handle portion; and wherein after removal of the fastener, rotation of the left handle portion with respect to the first blade portion and the right handle portion allows the protrusion to line up with a slot in the first plate to thereby allow the removal of the left handle portion from the first blade portion and the right handle portion.

2. The apparatus of claim 1 wherein after removal of the fastener, with the left handle portion oriented to be at an angle with respect to the first blade portion and the right handle portion, the left handle portion and the right handle portion are configured to be separated from the first blade portion and from each other.

3. The apparatus of claim 1 wherein in the first state, the protrusion is substantially perpendicular to the slot of the first plate, thereby preventing the left handle portion from being separated from the first blade portion and the right handle portion.

4. The apparatus of claim 1 wherein the protrusion is inserted through an opening in the first blade portion and through an opening in the first plate to thereby connect the second ends of the left handle portion and the right handle portion, and the intermediate part of the first blade portion, with the first blade portion sandwiched between the left handle portion and the right handle portion.

5. An apparatus comprising:

a left handle portion;

a right handle portion;

a first blade portion;

a first device;

and a fastener;

wherein the fastener is configured to connect in a first state, first ends of the left handle portion, the right handle portion, and the first blade portion to each other, with the first blade portion sandwiched between the left handle portion and the right handle portion;

wherein the first device is configured to connect second ends of the left handle portion and the right handle portion and an intermediate part of the first blade portion;

wherein in the first state the left handle portion, the right handle portion, and the first blade portion are fixed to each other so that their orientation with respect to one another cannot be changed without disconnecting the fastener so that it no longer connects the first ends of the left handle portion, the right handle portion, and the first blade portion;

wherein removal of the fastener from the left handle portion, the first blade portion, and the right handle portion, allows the left handle portion to rotate with respect to the first blade portion and the right handle portion, while the left handle portion is connected to the first blade portion and the right handle portion;

wherein the fastener is inserted through an opening in the first blade portion and through an opening of the left handle portion to thereby connect the first ends of the left handle portion, the right handle portion, and the first blade portion, with the first blade portion sandwiched between the left handle portion and the right handle portion, in the first state.

6. The apparatus of claim 1 wherein the left handle portion, the right handle portion, and the first blade portion are substantially parallel to each other in the first state.

7. An apparatus comprising:

a left handle portion;

a right handle portion;

a first blade portion;

a first device;

and a fastener;

wherein the fastener is configured to connect in a first state, first ends of the left handle portion, the right handle portion, and the first blade portion to each other, with the first blade portion sandwiched between the left handle portion and the right handle portion;

wherein the first device is configured to connect second ends of the left handle portion and the right handle portion and an intermediate part of the first blade portion;

wherein in the first state the left handle portion, the right handle portion, and the first blade portion are fixed to each other so that their orientation with respect to one another cannot be changed without disconnecting the fastener so that it no longer connects the first ends of the left handle portion, the right handle portion, and the first blade portion;

wherein removal of the fastener from the left handle portion, the first blade portion, and the right handle portion, allows the left handle portion to rotate with respect to the first blade portion and the right handle portion, while the left handle portion is connected to the first blade portion and the right handle portion; and further comprising a second blade portion;

wherein the first blade portion is configured to be detached from the left handle portion and the right handle portion;

wherein the second blade portion is configured to replace the first blade portion and to be attached to the left handle portion and the right handle portion;

wherein the fastener is configured to connect in a second state, first ends of the left handle portion, the right handle portion, and the second blade portion to each other, with the second blade portion sandwiched between the left handle portion and the right handle portion;

wherein the first device is configured to connect second ends of the left handle portion and the right handle portion and an intermediate part of the second blade portion;

wherein in the second state the left handle portion, the right handle portion, and the second blade portion are fixed to each other so that their orientation with respect to one another cannot be changed without disconnecting the fastener so that it no longer connects the first ends of the left handle portion, the right handle portion, and the second blade portion; and and wherein removal of the fastener from the left handle portion, the right handle portion, and the second blade portion allows the left handle portion to rotate with respect to the second blade portion and the right handle portion, while the left handle portion is connected to the second blade portion and the right handle portion.

8. A method comprising the steps of:

fixing a left handle portion, a right handle portion, and a first blade portion together in a first state by use of fastener and a first device so that the left handle portion, the right handle portion, and the first blade portion are fixed in orientation and position with respect to each other;

removing the fastener from the left handle portion, the right handle portion, and the first blade portion; and rotating the left handle portion with respect to the right handle portion and the first blade portion, while the left handle portion, the right handle portion and the first blade portion are connected together;

wherein the fastener is configured to connect in the first state, first ends of the left handle portion, the right handle portion, and the first blade portion to each other, with the first blade portion sandwiched between the left handle portion and the right handle portion;

wherein the first device is configured to connect second ends of the left handle portion and the right handle portion and an intermediate part of the first blade portion;

wherein in the first state the left handle portion, the right handle portion, and the first blade portion are fixed to each other so that their orientation with respect to one another cannot be changed without disconnecting the fastener so that it no longer connects the first ends of the left handle portion, the right handle portion, and the first blade portion; and and wherein removal of the fastener from the left handle portion, the first blade portion, and the right handle portion, allows the left handle portion to rotate with respect to the first blade portion and the right handle portion, while the left handle portion is connected to the first blade portion and the right handle portion.

9. The method of claim 8 wherein separating the left handle portion and the right handle portion from each other and from the first blade portion after removal of the fastener, with the left handle portion oriented to be at an angle with respect to the first blade portion and the right handle portion.

10. The method of claim 8 wherein the first device includes a first plate fixed to the left handle portion, and a protrusion fixed to the right handle portion; and wherein after removal of the fastener, rotation of the left handle portion with respect to the first blade portion and the right handle portion allows the protrusion to line up with a slot in the first plate to thereby allow the removal of the left handle portion from the first blade portion and the right handle portion.

11. The method of claim 10 wherein in the first state, the protrusion is substantially perpendicular to the slot of the first plate, thereby preventing the left handle portion from being separated from the first blade portion and the right handle portion.

12. The method of claim 10 wherein the protrusion is inserted through an opening in the first blade portion and through an opening in the first plate to thereby connect the second ends of the left handle portion and the right handle portion, and the intermediate part of the first blade portion, with the first blade portion sandwiched between the left handle portion and the right handle portion.

13. The method of claim 8 wherein the fastener is inserted through an opening in the first blade portion and through an opening of the left handle portion to thereby connect the first ends of the left handle portion, the right handle portion, and the first blade portion, with the first blade portion sandwiched between the left handle portion and the right handle portion, in the first state.

14. The method of claim 8 wherein the left handle portion, the right handle portion, and the first blade portion are substantially parallel to each other in the first state.

15. The method of claim 8 further comprising detaching the first blade portion from the left handle portion and the right handle portion;

replacing the first blade portion with a second blade portion;

attaching the second blade portion to the left handle portion and the right handle portion;

wherein the fastener is configured to connect in a second state, first ends of the left handle portion, the right handle portion, and the second blade portion to each other, with the second blade portion sandwiched between the left handle portion and the right handle portion;

wherein the first device is configured to connect second ends of the left handle portion and the right handle portion and an intermediate part of the second blade portion;

wherein in the second state the left handle portion, the right handle portion, and the second blade portion are fixed to each other so that their orientation with respect to one another cannot be changed without disconnecting the fastener so that it no longer connects the first ends of the left handle portion, the right handle portion, and the second blade portion; and and wherein removal of the fastener from the left handle portion, the right handle portion, and the second blade portion allows the left handle portion to rotate with respect to the second blade portion and the right handle portion, while the left handle portion is connected to the second blade portion and the right handle portion.

* * * * *